US009738965B2

(12) United States Patent
Sagawa et al.

(10) Patent No.: US 9,738,965 B2
(45) Date of Patent: Aug. 22, 2017

(54) RFEB SYSTEM SINTERED MAGNET PRODUCTION METHOD AND RFEB SYSTEM SINTERED MAGNET

(71) Applicants: INTERMETALLICS CO., LTD., Nakatsugawa-shi, Gifu (JP); DAIDO STEEL CO., LTD., Nagoya-shi, Aichi (JP)

(72) Inventors: Masato Sagawa, Kyoto (JP); Shinobu Takagi, Niwa-gun (JP)

(73) Assignees: INTERMETALLICS CO., LTD., Nakatsugawa (JP); DAIDO STEEL CO., LTD., Nagoya (JP)

( * ) Notice: Subject to any disclaimer, the term of this patent is extended or adjusted under 35 U.S.C. 154(b) by 0 days.

(21) Appl. No.: 14/777,624

(22) PCT Filed: Mar. 13, 2014

(86) PCT No.: PCT/JP2014/056705
§ 371 (c)(1),
(2) Date: Sep. 16, 2015

(87) PCT Pub. No.: WO2014/148356
PCT Pub. Date: Sep. 25, 2014

(65) Prior Publication Data

US 2016/0273091 A1 Sep. 22, 2016

(30) Foreign Application Priority Data

Mar. 18, 2013 (JP) ..... 2013-055740

(51) Int. Cl.
*H01F 1/057* (2006.01)
*C23C 10/30* (2006.01)
(Continued)

(52) U.S. Cl.
CPC ..... *C23C 10/30* (2013.01); *B22F 1/0059* (2013.01); *B22F 3/16* (2013.01); *B22F 3/24* (2013.01);
(Continued)

(58) Field of Classification Search
CPC .. H01F 1/0577; B22F 3/24; B22F 3/16; B22F 1/0059; C23C 10/30; C22C 38/16;
(Continued)

(56) References Cited

U.S. PATENT DOCUMENTS

| | | | |
|---|---|---|---|
| 5,935,722 | A | 8/1999 | Moorhead et al. |
| 2007/0151632 | A1 | 7/2007 | Komuro et al. |
| 2013/0026870 | A1 | 1/2013 | Baba et al. |

FOREIGN PATENT DOCUMENTS

| | | | |
|---|---|---|---|
| CN | 101517670 | A | 8/2009 |
| CN | 101521068 | A | 9/2009 |

(Continued)

OTHER PUBLICATIONS

Feb. 15, 2016 Search Report issued in European Patent Application No. 14768056.5.

(Continued)

*Primary Examiner* — Bernard Rojas
(74) *Attorney, Agent, or Firm* — Oliff PLC

(57) ABSTRACT

Producing an RFeB system sintered magnet with high corrosion resistance and low loss of energy in an RFeB system sintered magnet with high magnetic properties produced by a grain boundary diffusion process. A paste prepared by mixing an organic matter having a molecular structure including an oxygen atom and a metallic powder containing a heavy rare-earth element which is at least one element selected from the group of Dy, Ho and Tb, is applied to the surface of an RFeB system sintered compact composed of crystal grains whose main phase is $R_2Fe_{14}B$
(Continued)

containing, as a main rare-earth element, a light rare-earth element which is at least one element selected from the group of Nd and Pr. A heating process for a grain boundary diffusion treatment is performed. As a result, a protective layer containing an oxide of the light rare-earth element is formed on the surface.

2 Claims, 2 Drawing Sheets

(51) Int. Cl.

| | |
|---|---|
| ***C22C 38/00*** | (2006.01) |
| ***B22F 1/00*** | (2006.01) |
| ***H01F 41/02*** | (2006.01) |
| ***C22C 28/00*** | (2006.01) |
| ***C22C 38/02*** | (2006.01) |
| ***C22C 38/10*** | (2006.01) |
| ***C22C 38/16*** | (2006.01) |
| ***B22F 3/16*** | (2006.01) |
| ***B22F 3/24*** | (2006.01) |
| ***C22C 38/06*** | (2006.01) |

(52) U.S. Cl.
CPC ..... *C22C 28/00* (2013.01); *C22C 38/00* (2013.01); *C22C 38/002* (2013.01); *C22C 38/005* (2013.01); *C22C 38/02* (2013.01); *C22C 38/06* (2013.01); *C22C 38/10* (2013.01); *C22C 38/16* (2013.01); *H01F 1/0577* (2013.01); *H01F 41/0293* (2013.01); *B22F 2003/248* (2013.01); *B22F 2301/355* (2013.01); *B22F 2301/45* (2013.01); *B22F 2302/45* (2013.01); *B22F 2303/20* (2013.01); *B22F 2303/40* (2013.01); *B22F 2998/10* (2013.01); *C22C 2202/02* (2013.01)

(58) Field of Classification Search
CPC ..... C22C 38/10; C22C 38/06; C22C 38/005; C22C 38/002; C22C 28/00
See application file for complete search history.

(56) References Cited

FOREIGN PATENT DOCUMENTS

| | | | |
|---|---|---|---|
| CN | 102822912 | A | 12/2012 |
| CN | 103098151 | A | 5/2013 |
| CN | 103890880 | A | 6/2014 |
| EP | 1744328 | A2 | 1/2007 |
| EP | 1788594 | A1 | 5/2007 |
| EP | 1970924 | A1 | 9/2008 |
| EP | 2071597 | A1 | 6/2009 |
| EP | 2555207 | A1 | 2/2013 |
| EP | 2879142 | A1 | 6/2015 |
| EP | 2889883 | A1 | 7/2015 |
| GB | 1257033 | A | 12/1971 |
| GB | 2497573 | A | 6/2013 |
| JP | H02-65103 | A | 3/1990 |
| JP | H06-244011 | A | 9/1994 |
| JP | 2002-129351 | A | 5/2002 |
| JP | 2006-344854 | A | 12/2006 |
| JP | 2007-258455 | A | 10/2007 |
| JP | 2009-049378 | A | 3/2009 |
| JP | 2010-114200 | A | 5/2010 |
| KR | 20090074767 | A | 7/2009 |
| WO | 2008032426 | A1 | 3/2008 |
| WO | 2011/122667 | A1 | 10/2011 |

OTHER PUBLICATIONS

Feb. 15, 2016 Search Report issued in European Patent Application No. 14768481.5.
Jun. 24, 2014 Written Opinion issued in International Patent Application No. PCT/JP2014/056705.
Jun. 24, 2014 International Search Report issued in International Patent Application No. PCT/JP2014/056704.
Jul. 25, 2016 Office Action issued in Chinese Patent Application No. 201480016959.2.
Aug. 25, 2016 Office Action issued in Chinese Patent Application No. 201480016961.X.
Oct. 14, 2016 Office Action issued in U.S. Appl. No. 14/777,556.
Oct. 7, 2016 Office Action issued in Korean Patent Application No. 10-2015-7027968.
Jan. 10, 2017 Office Action issued in Japanese Patent Application No. 2015-506729.
Jan. 22, 2017 Office Action issued in Chinese Patent Application No. 201480016959.2.
Jan. 10, 2017 Office Action issued in Japanese Patent Application No. 2015-506730.
Jan. 17, 2017 Office Action issued in European Patent Application No. 14768481.5.
Oct. 10, 2016 Office Action issued in Korean Patent Application No. 10-2015-7028646.
Mar. 27, 2017 Office Action issued in Korean Patent Application No. 10-2015-7028646.
Apr. 1, 2017 Office Action issued in Chinese Patent Application No. 201480016961.X.
May 18, 2017 Office Action issued in U.S. Appl. No. 14/777,556.
May 8, 2017 Office Action issued in Korean Patent Application No. 10-2015-7028646.
May 8, 2017 European Office Action issued in European Patent Application No. 14768056.5.
May 10, 2017 Office Action issued in European Patent Application No. 14768481.5.

HEATED IN VACUUM (AT 900℃)

100 μm (COMMON TO ALL IMAGES)

PRESENT EXAMPLE

COMPARATIVE EXAMPLE 1

RFEB SYSTEM SINTERED MAGNET PRODUCTION METHOD AND RFEB SYSTEM SINTERED MAGNET

TECHNICAL FIELD

The present invention relates to a method for producing an RFeB system sintered magnet whose main phase is made of $R_2Fe_{14}B$ containing, as its main rare-earth element R, at least one element selected from the group of Nd and Pr (these two rare-earth elements are hereinafter called the "light rare-earth element $R_L$), as well as an RFeB system sintered magnet produced by the same method. The "RFeB system sintered magnet" is not limited to a magnet which contains no other element than Nd, Pr, Fe and B; it may also contain a rare-earth element which is neither Nd nor Pr, or contain other elements such as Co, Ni, Cu or Al.

BACKGROUND ART

RFeB system sintered magnets were discovered in 1982 by Sagawa (one of the present inventors) and other researchers. The magnets have the characteristic that most of their magnetic characteristics (e.g. residual magnetic flux density) are far better than those of other conventional permanent magnets. Therefore, RFeB system sintered magnets are used in a variety of products, such as driving motors for hybrid or electric automobiles, battery-assisted bicycle motors, industrial motors, voice coil motors (used in hard disk drives or other apparatuses), high-grade speakers, headphones, and permanent magnetic resonance imaging systems.

In the RFeB system sintered magnet, the grains of the main phase ($R_2Fe_{14}B$) are surrounded by an $R_L$-rich phase having a higher Nd content than the main phase and a B-rich phase having a higher B content than the main phase. Among these phases, the main phase and $R_L$-rich phase become easily oxidized when they are in contact with oxygen or water. The $R_L$-rich phase is particularly easy to be oxidized. If the $R_L$-rich phase is oxidized, a brittle region made of an oxide, hydroxide or similar compound of $R_L$ is formed, which may cause discoloration or rust in a region near the surface of the RFeB system sintered magnet and consequently cause the main phase grains in the surface region to come off.

Patent Literature 1 discloses the technique of performing a fluorination treatment on the surface of a produced RFeB system sintered magnet to form a protective layer made of a fluoride of rare earth R on that surface. This protective layer produces an anti-corrosion effect for preventing the RFeB system sintered magnet from being corroded due to oxidization. However, this method requires the additional process of forming the protective layer.

Patent Literature 2 discloses a method in which a protective layer is formed on the surface of an RFeB system sintered magnet by using a grain boundary diffusion method.

In the grain boundary diffusion method, a powder or some other form of material containing a heavy rare-earth element $R_H$ (Tb, Dy or Ho) is made to be in contact with the surface of the RFeB system sintered magnet and heated, whereby $R_H$ atoms are diffused through the grain boundaries of the RFeB system sintered magnet into the inner regions. However, $R_H$ are rare and expensive elements, and furthermore, they unfavorably decrease the residual magnetic flux density $B_r$ and the maximum energy product $(BH)_{max}$ of the RFeB system sintered magnet. With the grain boundary diffusion method, it is possible to overcome these problems while at the same time improving the coercivity, by introducing $R_H$ into only the regions near the grain boundaries in the RFeB system sintered magnet. As just noted, the grain boundary diffusion is originally a treatment process aimed at improving the coercivity. However, according to the method described in Patent Literature 2, the single process of heating the RFeB system sintered magnet, with a metallic powder containing Ni and/or Co with $R_H$ placed in contact with its surface, can produce both the effect of improving the coercivity and the anti-corrosion effect by a layer which remains on the surface of the RFeB system sintered magnet after the heating process for the grain boundary diffusion is completed.

CITATION LIST

Patent Literature

Patent Literature 1: JP 06-244011 A
Patent Literature 2: WO 2008/032426 A

SUMMARY OF INVENTION

Technical Problem

When used in a motor or some other types of applications, RFeB system sintered magnets are exposed to an externally-applied changing magnetic field. Such a field induces eddy current, particularly in the surface area of the magnet. In the RFeB system sintered magnet described in Patent Literature 2, since the protective layer is made of metal, the eddy current easily occurs in the surface area, which causes a loss of energy.

The problem to be solved by the present invention is to provide a method for producing an RFeB system sintered magnet with high corrosion resistance and low loss of energy in an RFeB system sintered magnet with high magnetic properties produced by using a grain boundary diffusion process, as well as to provide an RFeB system sintered magnet produced by the same method.

Solution to Problem

The RFeB system sintered magnet production method according to the present invention developed for solving the previously described problem, characterized in that:

a paste prepared by mixing an organic matter having a molecular structure including an oxygen atom and a metallic powder containing a heavy rare-earth element $R_H$ which is at least one element selected from the group of Dy, Ho and Tb, is applied to the surface of an RFeB system sintered compact composed of crystal grains whose main phase is $R_2Fe_{14}B$ containing, as a main rare-earth element R, a light rare-earth element $R_L$ which is at least one element selected from the group of Nd and Pr; and a heating process for a grain boundary diffusion treatment is performed, with the paste in contact with the surface.

The heating process can be performed under the same conditions as in the conventional grain boundary diffusion treatment. For example, according to Patent Literature 1, the heating process is performed within the range of 700° C.-1000° C. This heating temperature should be set within a range where the grain boundary diffusion can most efficiently occur while causing little sublimation of the heavy rare-earth element Rx. A preferable range is 850° C.-950° C.

In the RFeB system sintered magnet production method according to the present invention, a heavy rare-earth element $R_H$ is diffused into the RFeB system sintered compact through its grain boundaries by heating the compact with the paste containing the heavy rare-earth element $R_H$ placed in contact with its surface. Therefore, similarly to the case of using the conventional grain boundary diffusion treatment, it is possible to improve the coercivity $H_{cJ}$, with a small amount of $R_H$, while reducing the amount of decrease in the residual magnetic flux density $B_r$ and the maximum energy product $(BH)_{max}$. Furthermore, the present invention produces the following effect.

Due to the diffusion of the heavy rare-earth element $R_H$ into the RFeB system sintered compact, the light rare-earth element $R_L$ within the RFeB system sintered compact is displaced by the heavy rare-earth element $R_H$. The displaced light rare-earth element $R_L$ is deposited on the surface of the RFeB system sintered compact and reacts with the oxygen atom included in the molecule of the organic matter on that surface. As a result, a protective layer containing an oxide of the light rare-earth element $R_L$ is formed on the surface of the RFeB system sintered magnet, whereby the corrosion resistance of the magnet is improved. Since this protective layer contains an oxide, its electric resistivity is higher than a protective layer made of metal. Therefore, it can suppress an occurrence of eddy current and thereby decrease the loss of energy. Such a protective layer containing an oxide is also highly adherent to RFeB system sintered magnets.

An RFeB system sintered magnet according to the present invention is characterized in that: a protective layer containing an oxide of a light rare-earth element $R_L$ which is at least one element selected from the group of Nd and Pr is formed on the surface of an RFeB system sintered compact made of crystal grains whose main phase is $R_2Fe_{14}B$ containing the light rare-earth element $R_L$ as a main rare-earth element R; and a heavy rare-earth element $R_H$ which is at least one element selected from the group of Dy, Ho and Tb is diffused in the boundary of the crystal grains.

Advantageous Effects of the Invention

With the present invention, it is possible to obtain an RFeB system sintered magnet with high magnetic properties produced by using a grain boundary diffusion process, with the corrosion resistance improved by the protective layer containing an oxide of a light rare-earth element $R_L$ formed on its surface, the occurrence of eddy current suppressed by the surface layer having a high electric resistivity, and the consequent loss of energy thereby reduced.

DESCRIPTION OF EMBODIMENTS

Figure 1A:
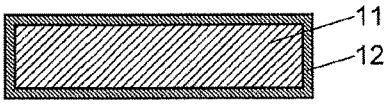
FIGS. 1A-1C are vertical sectional views showing one example of the production method for an RFeB system sintered magnet according to the present invention.

One example of the RFeB system sintered magnet production method and the RFeB system sintered magnet according to the present invention is described using FIGS. 1A-3B.

EXAMPLE

(1) Production Method for RFeB System Sintered Compact

The production method for an RFeB system sintered magnet of the present example includes the following processes: (1-1) creation of an RFeB system sintered compact 11 (see FIGS. 1A-1C) before the protective layer is formed, (1-2) preparation of a paste 12 (FIGS. 1A-1C) by mixing a metallic powder containing a heavy rare-earth element $R_H$ and an organic matter having a molecular structure including an oxygen atom, and (1-3) a grain boundary diffusion treatment using the RFeB system sintered compact and paste prepared in the previous processes. These processes are hereinafter sequentially described.

(1-1) Creation of RFeB System Sintered Compact 11

Initially, a raw-material alloy containing 25-40% by weight of $R_L$ and 0.6-1.6% by weight of B, with the balance being Fe and unavoidable impurities is prepared. A portion of $R_L$ may be replaced by other rare-earth elements, such as $R_H$. A portion of B may be replaced by C. A portion of Fe may be replaced by other transitional metal elements (e.g. Co or Ni). The alloy may additionally contain one or more kinds of additive elements selected from the group of Al, Si, Cr, Mn, Co, Ni, Cu, Zn, Mo and Zr (typically, the additive amount is 0.1-2.0% by weight of each kind). The composition of the raw-material alloy used in experiments (which will be described later) was Nd: 23.3% by weight, Pr: 5.0% by weight, Dy: 3.8% by weight, B: 0.99% by weight, Co: 0.9% by weight, Cu: 0.1% by weight, and Al: 0.2% by weight, with the balance being Fe.

This raw-material alloy is melted, and the molten alloy is processed into raw-material pieces by strip casting. Subsequently, the raw-material pieces are made to occlude hydrogen, whereby the pieces are coarsely pulverized to a size ranging from 0.1 mm to a few mm. Furthermore, the obtained particles are finely pulverized with a jet mill to obtain an alloy powder whose particle size as measured by a laser method is 0.1-10 μm, and more preferably 3-5 μm. A lubricant (e.g. methyl laurate) may be added as the grinding aid in the coarse pulverization and/or fine pulverization process. The methods of coarse and fine pulverizations are not limited to the aforementioned ones; for example, a method using an attritor, ball mill or bead mill may also be employed.

After a lubricant (e.g. methyl laurate) is added to the obtained alloy powder (typically, the additive amount is approximately 0.1% by weight) and mixed, the alloy powder is placed in a filling container having a rectangular-parallelepiped inner space of 20 mm×20 mm×5 mm. Then, the alloy powder held in the filling container is oriented in a magnetic field, with no pressure applied. Subsequently, the alloy powder held in the filling container is heated (typically, the heating temperature is 950-1050° C.), with no pressure applied, whereby the alloy powder is sintered and a RFeB system sintered compact 11 having a rectangular-parallelepiped shape is obtained. In the experiments (which will be described later), the samples were sintered by heating them at 1000° C. for four hours.

(1-2) Preparation of Paste 12

In the present embodiment, a powder of TbNiAl alloy containing 92% by weight of Tb, 4.3% by weight of Ni and 3.7% by weight of Al was used as the $R_H$-containing metallic powder. The particle size of the $R_H$-containing metallic powder should preferably be as small as possible in order to diffuse it as uniformly as possible into the RFeB system sintered compact. However, an extremely small particle size leads to a considerable increase in the time and cost for the fine pulverization. Therefore, the particle size should be 2-100 μm, preferably 2-50 μm, and more preferably 2-20 μm. As the organic matter having a molecular structure including an oxygen atom, a silicone-based polymeric resin (silicone grease) is used. Silicone is a high-molecular compound whose main skeleton includes the siloxane bond formed by silicon atoms and oxygen atoms bonded together. By mixing those $R_H$-containing metallic powder and organic matter, a paste 12 is obtained.

The mixture ratio by weight of the $R_H$-containing metallic powder and the silicone grease may be arbitrarily selected so as to adjust the viscosity of the paste as desired. However, a lower percentage of the $R_H$-containing metallic powder means a smaller amount of $R_H$ atoms permeating through the RFeB system sintered compact during the grain boundary diffusion treatment. Accordingly, the percentage of the $R_H$-containing metallic powder should be 70% by weight or higher, preferably 80% by weight or higher, and more preferably 90% by weight or higher. The amount of silicone grease should preferably be 5% by weight or higher, since no satisfactory paste can be obtained if the amount of silicone grease is less than 5% by weight. In addition to the silicone grease, a silicone-based organic solvent may also be added to adjust the viscosity. Using only a silicone-based organic solvent is also possible.

Needless to say, the paste usable in the present invention is not limited to the previous example. As the $R_H$-containing metallic powder, a powder of simple $R_H$ metal may be used, or an alloy and/or intermetallic compound containing $R_H$, other than the aforementioned TbNiAl alloy, may also be used. A mixture of a powder of simple metal, alloy and/or intermetallic compound of $R_H$ and another kind of metallic powder can also be used. As for the organic matter having a molecular structure including an oxygen atom, a substance other than silicone may also be used.

(1-3) Grain Boundary Diffusion Treatment

Figure 1B:
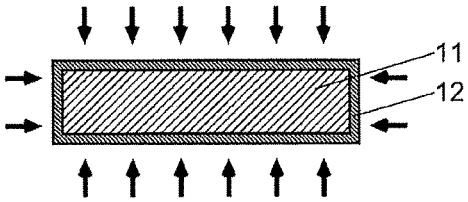
Figure 1C:
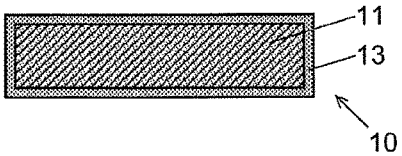

Initially, the six faces of the RFeB system sintered compact 11 having the rectangular parallelepiped shape are ground so as to remove scales adhered to those faces and to adjust the size of the RFeB system sintered compact 11 to 14 mm×14 mm×3.3 mm. Next, the paste 12 is applied to the six faces to a thickness of approximately 0.03 mm (FIG. 1A). In this state, the sintered compact is heated in vacuum (FIG. 1B). The heating temperature may be set in the same manner as in the case of the conventional grain boundary diffusion treatment. In the present example, the heating temperature is 900° C. By this heating process, the Tb atoms in the paste 12 are diffused through the grain boundaries of the RFeB system sintered compact 11 into its inner regions, replacing the $R_L$ atoms within the RFeB system sintered compact 11. The replaced $R_L$ atoms are transferred through the grain boundaries in the RFeB system sintered compact 11 to the surface of the same RFeB system sintered compact 11, where the atoms are oxidized due to reaction with the oxygen atoms in the molecular structure of the organic matter in the paste 12. Thus, an RFeB system sintered magnet 10 covered with a protective layer 13 containing an oxide of $R_L$ is created (FIG. 1C).

Similarly to the case of the conventional grain boundary diffusion treatment, the RFeB system sintered magnet 10 has high coercivity $H_{cJ}$ with only a small amount of decrease in the high residual magnetic flux density $B_r$ and the maximum energy product $(BH)_{max}$. The protective layer 13 formed on its surface prevents oxidization of the magnet and thereby improves its corrosion resistance. Furthermore, the oxide of $R_L$ contained in the protective layer 13 gives this layer a high electric resistivity, which suppresses the occurrence of eddy current and thereby decreases the loss of energy.

Figure 2A:
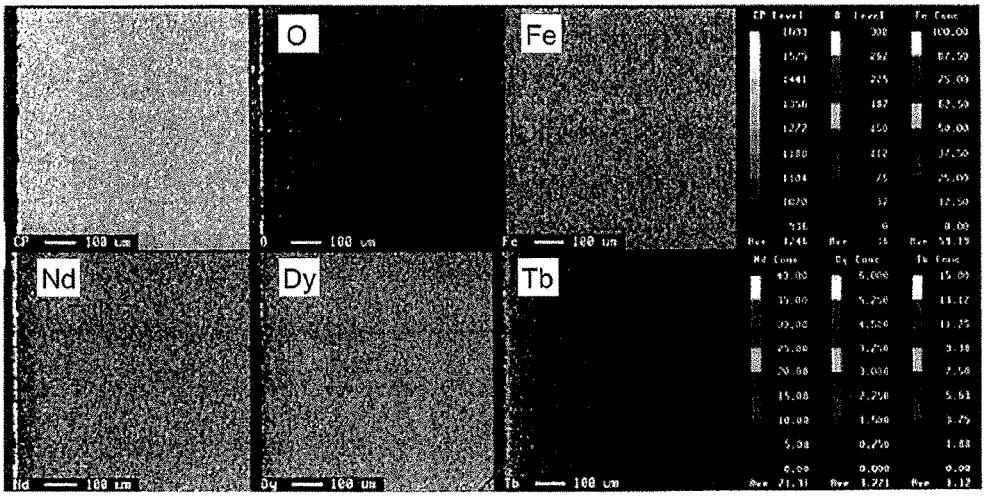
FIG. 2A shows the result of an EPMA measurement performed on an RFeB system sintered magnet of the present example.
Figure 2B:
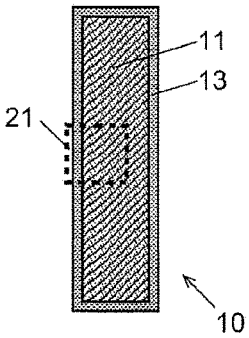
FIG. 2B is a schematic diagram showing the position in the RFeB system sintered magnet on which the measurement was performed.

(2) Result of Experiment Performed on RFeB System Sintered Magnet 10 of Present Example (2-1) Composition Analysis FIG. 2A shows the result of a composition analysis in which the atoms of oxygen (O), iron (Fe), neodymium (Nd), dysprosium (Dy) and terbium (Tb) in the RFeB system sintered magnet 10 of the present example were detected by an EPMA (electron probe microanalysis) method. This composition analysis was performed on the area 21 shown by the broken line in FIG. 2B, which is a portion of a section of the RFeB system sintered magnet 10 extending from its surface into the inner region. In FIG. 2A, the brighter areas (nearly white) represent the sites which contain higher amounts of atoms than the darker areas (nearly black). Regardless of the kind of element, a stripe-shaped area having a different color from the adjacent areas can be seen near the left end of the image (this end corresponds to the surface of the RFeB system sintered magnet 10), extending along the surface of the RFeB system sintered magnet 10 (or in the vertical direction in the image).

This result of the EPMA experiment illustrates the following facts: Firstly, in the image showing the Tb content, the level of brightness gradually decreases with the increasing distance from the surface of the RFeB system sintered magnet 10. This means that the Tb atoms have been diffused from the surface of the RFeB system sintered magnet 10 into the inner regions.

In the image showing the Nd content, the brightness is highest in the region near the surface of the RFeB system sintered magnet 10. This region corresponds to the protective layer 13. The image also shows that the brightness transiently decreases across the region from the surface to a depth of approximately 50 μm, below which it slightly increases. An explanation of such a brightness distribution is that the amount of Nd at small depths (approximately 50 μm or less) from the surface of the RFeB system sintered magnet 10 has been decreased, and an amount of Nd corresponding to that decrease has been deposited in the surface region. The most likely reason for this deposition is that a portion of the Nd atoms which were originally contained in the RFeB system sintered compact 11 before the grain boundary diffusion treatment have been displaced by the Tb atoms diffused into the RFeB system sintered magnet 10.

In the image showing the content of 0 atoms, the area corresponding to the protective layer 13 can be brightly seen. Accordingly, the protective layer 13 is abundant in Tb, Nd and O atoms. Since the organic matter originally contained in the paste 12 is vaporized during the heating process in the grain boundary diffusion treatment, the 0 atoms remaining in this way after the grain boundary diffusion treatment take the form of oxides of Tb and Nd. That is to say, the protective layer 13 contains oxides of Tb and Nd.

(2-2) Anti-Corrosion Test and Measurement Experiment of Magnetic Properties

An anti-corrosion test and measurement experiment of magnetic properties have been conducted for the RFeB system sintered magnet 10 of the present example. For comparison, the same experiments have also been performed for two more samples: a sample prepared by removing the protective layer 13 from the RFeB system sintered magnet 10 by grinding its surface (Comparative Example 1), and an RFeB system sintered compact 11 for which the grain boundary diffusion treatment was not performed (Comparative Example 2).

In the anti-corrosion test, the samples were contained in a thermo-hygrostat at a temperature of 85° C. and a humidity of 85% for 500 hours, after which the samples were visually checked to determine whether or not the main phase grains had detached from their surfaces. Subsequently, the same samples were once more contained in the thermo-hygrostat at the same temperature and humidity for 500 more hours (a total of 1000 hours), and were subsequently checked for whether or not the main phase grains had detached. In the measurement experiment of magnetic properties, the samples were worked into a size of 7×7×3 mm, and their residual magnetic flux density $B_r$, coercivity $H_{cJ}$ and volume resistivity at room temperature (23° C.) were measured.

The results of these experiments are shown in Table 1.

TABLE 1

| | Description of Sample | Anti-Corrosion Test 500 hr. | Anti-Corrosion Test 1000 hr. | Magnetic Properties $B_r$ [kG] | Magnetic Properties $H_{cJ}$ [kOe] | Volume Resistivity [μΩ · cm] |
|---|---|---|---|---|---|---|
| Present Example | RFeB System Sintered Magnet 10 | ○ | ○ | 12.3 | 33.6 | 2311 |
| Comparative Example 1 | RFeB System Sintered Magnet 10 without Protective Layer 13 | x | x | 12.2 | 31.3 | 124 |
| Comparative Example 2 | RFeB System Sintered Compact 11 (Grain Boundary Diffusion Not Performed) | x | — | 11.2 | 21.7 | 119 |

Figure 3A:
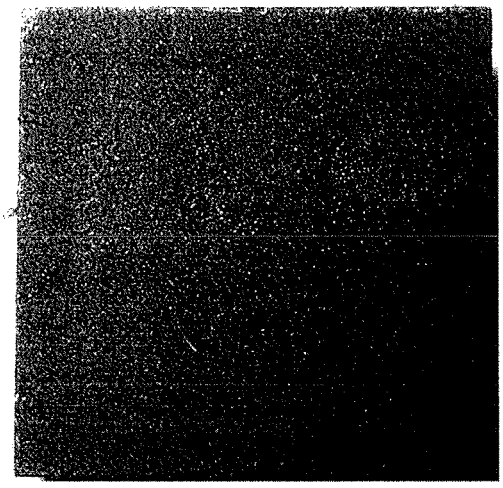
FIGS. 3A and 3B are photographs respectively showing the surface of a sample in the present example and that of a sample in a comparative example after an anti-corrosion test.
Figure 3B:
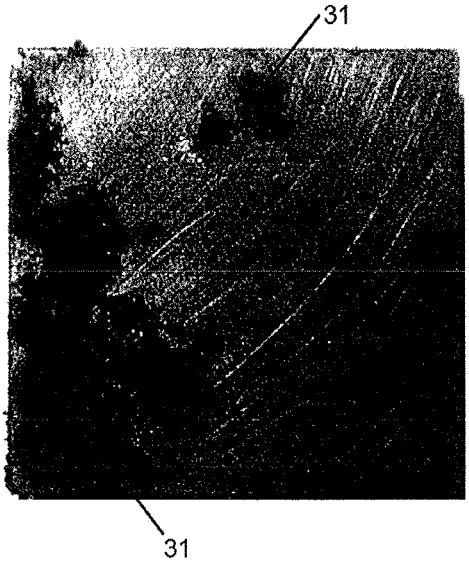

The anti-corrosion test confirmed that the sample of the present example had high corrosion resistance; no discoloration or rust occurred on its surface after being exposed to the aforementioned conditions of temperature and humidity for 500 hours or a total of 1000 hours. FIG. 3A is a photograph showing the surface of the sample of the present example taken after the elapse of 1000 hours. By contrast, in both of Comparative Examples 1 and 2, after the first 500-hour process at the aforementioned temperature and humidity was completed, the discoloration and rust were found on the surface of the sample, and main phase grains were found to have come off the surface. FIG. 3B is a photograph showing the sample of Comparative Example 1 taken after the 1000-hour anti-corrosion test was completed. Rust 31 is formed on the sample surface.

The measurement experiment of magnetic properties demonstrated that, as compared to the sample of Comparative Example 2 for which the grain boundary diffusion treatment was not performed, the sample of the present example had a 1.5-times higher coercivity Her and yet no decrease in the residual magnetic flux density $B_r$ occurred.

The measurement experiment of the volume resistivity was conducted by a four-terminal method, with two terminals for passing electric current through a sample placed on the surface of the sample and two terminals for measuring voltage placed between the two current-passing terminals. The result of this experiment demonstrated that the volume resistivity of the present example was approximately 20 times as high as that of the comparative example, which means that the present example can more effectively prevent eddy current than the comparative example.

REFERENCE SIGNS LIST

10 . . . RFeB System Sintered Magnet
11 . . . RFeB System Sintered Compact
12 . . . Paste
13 . . . Protective Layer
21 . . . Area of RFeB system Sintered Magnet Subjected to Composition Analysis
31 . . . Rust

The invention claimed is:

1. A method for producing an RFeB system sintered magnet, comprising:

preparing a paste by mixing an organic matter having a molecular structure including an oxygen atom and a metallic powder containing a heavy rare-earth element $R_H$ which is at least one element selected from a group of Dy, Ho and Tb, and applying the paste to a surface of an RFeB system sintered compact composed of crystal grains whose main phase is $R_2Fe_{14}B$ containing, as a main rare-earth element R, a light rare-earth element $R_L$ which is at least one element selected from a group of Nd and Pr;

performing a heating process for a grain boundary diffusion treatment, with the paste in contact with the surface; and leaving a protective layer containing an oxide of the light rare-earth element $R_L$ that is formed on the surface of the RFeB system sintered compact by the heating process.

2. An RFeB system sintered magnet, comprising:

a protective layer containing an oxide of a light rare-earth element $R_L$ which is at least one element selected from a group of Nd and Pr is formed on a surface of an RFeB system sintered compact composed of crystal grains whose main phase is $R_2Fe_{14}B$ containing the light rare-earth element $R_L$ as a main rare-earth element R; and a heavy rare-earth element $R_H$ which is at least one element selected from a group of Dy, Ho and Tb is diffused in a boundary of the crystal grains.

* * * * *